US005302975A

United States Patent [19]

Whritenor

[11] Patent Number: 5,302,975

[45] Date of Patent: Apr. 12, 1994

[54] TRANSPORT ROLLER HAVING COMPRESSIBLE HUBS

[75] Inventor: James A. Whritenor, Mendon, N.Y.

[73] Assignee: Eastman Kodak Company, Rochester, N.Y.

[21] Appl. No.: 895,074

[22] Filed: Jun. 8, 1992

[51] Int. Cl.[5] ..... B41J 11/00

[52] U.S. Cl. ..... 346/136; 366/134; 366/76 PH; 400/636; 400/639; 400/639.1; 400/637

[58] Field of Search ..... 346/76 PH, 134, 136; 400/636, 639, 639.1, 657

[56] References Cited

U.S. PATENT DOCUMENTS 1,826,495 10/1931 Beck .
2,066,031 12/1936 Cowan ..... 101/348
2,862,250 12/1958 Fusaroli ..... 19/143
4,269,594 5/1981 Umans et al. ..... 432/59
4,768,041 8/1988 Sato et al. ..... 346/76 PH
4,893,134 1/1990 Yamamoto et al. ..... 346/76 PH
5,172,136 12/1992 Stephenson, III ..... 346/136

*Primary Examiner*—Benjamin R. Fuller
*Assistant Examiner*—Huan Tran
*Attorney, Agent, or Firm*—Milton S. Sales

[57] ABSTRACT

A nip-roller pair for transporting a sheet or web of material has one regular roller and a special roller to prevent scarring of the transported material. The special roller has one or more hubs of soft, compressible material that engage the material and hold the material away from the harder, rougher surface of the roller. The rollers close to compress the hubs and transport the material 15 Claims, 1 Drawing Sheet

TRANSPORT ROLLER HAVING COMPRESSIBLE HUBS

TECHNICAL FIELD

This invention pertains generally to material transporting, and, more particularly, to rollers for transporting material accurately without scratching.

BACKGROUND OF THE INVENTION

In devices that transport material, such as the dye receiving material in a thermal printer, it is important to prevent scratching of the material In a thermal printer, the scratches can remove the dyes or otherwise cause the image to be of unacceptable quality. This is especially true of transparent materials where both sides of the transparent material can be damaged by scratching. The drive means for transporting the dye receiving material through the printer, and maintaining proper registration during a printing function, must grip the material to do so. In some cases, rough surfaces are used which can cause scratches if the material is passed by them with a difference in relative velocity between the material and surface of the rough roller or drive means, during loading and unloading, for example. Hard rough rollers are preferable because they do not deflect under pinching loads, and more accurate transport is therefore achievable. Accordingly, it will be appreciated that it would be highly desirable to have a transport mechanism that uses rough surface rollers for good registration.

Other transport systems that have also been concerned with scratches include roll feed printers that would scratch only the leading edge of the roll and not the entire sheet. Sheet printers are prone to this scratch damage. For this reason, some machines do not use rough surfaces to transport and grip the material, but most of these require higher loads to accomplish the task of maintaining good control of the sheet Accordingly, it will be appreciated that it would be highly desirable to have a transport mechanism that uses rough surface rollers for good registration but uses lower loads and prevent scratches.

SUMMARY OF THE INVENTION

The present invention is directed to overcoming one or more of the problems set forth above. According to one aspect of the present invention, a thermal printer has a printing platen and a print head to effect thermal transfer of dye from a dye donor web onto a receiving medium traversing a path between the print head and a take-up spool. A first roller has a surface and is positioned between the print head and the take-up spool. A second roller has first and second end portions, a middle portion intermediate the end portions, a longitudinal axis, and a cylindrical surface concentric with the longitudinal axis and radially spaced a first preselected distance from the axis. The rollers are movable between an open position at which the rollers are spaced apart, and a closed position at which the rollers abut one another. The second roller has a hub with an outer surface concentric with the axis and radially spaced from the axis a distance greater than the first preselected distance. The hub outer surface extends radially outward beyond the cylindrical surface a distance sufficient to engage the dye receiver without the receiver coming into contact with the cylindrical surface so that the receiver can be transported by the hub with the rollers in the open position.

The hub is compressible in response to transporting contact with the first roller at the the closed position so that the hub surface is flush with the cylindrical surface. The hub returns to its normal size when the compressive force is removed and thereby prevents the receiver media from adhering to the surface of the roller.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
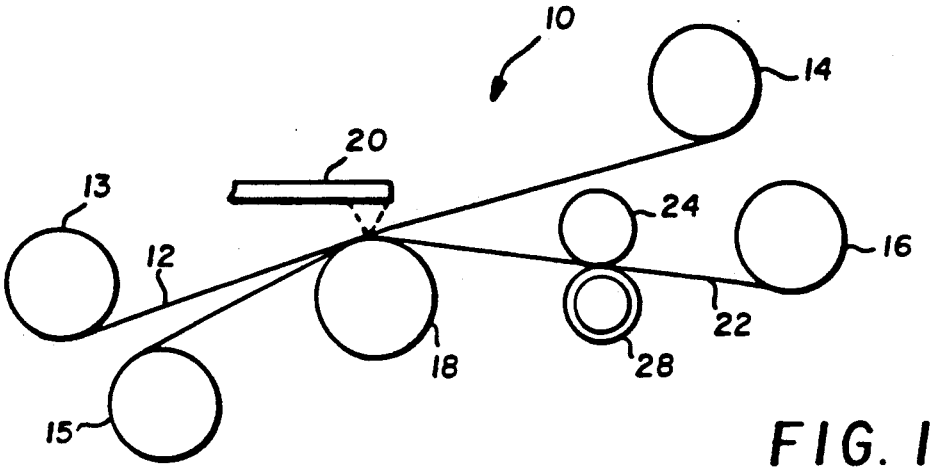
FIG. 1 is a diagrammatical view of a preferred embodiment of a thermal printer incorporating a nip-roller pair in accordance with the present invention.
Figure 2:
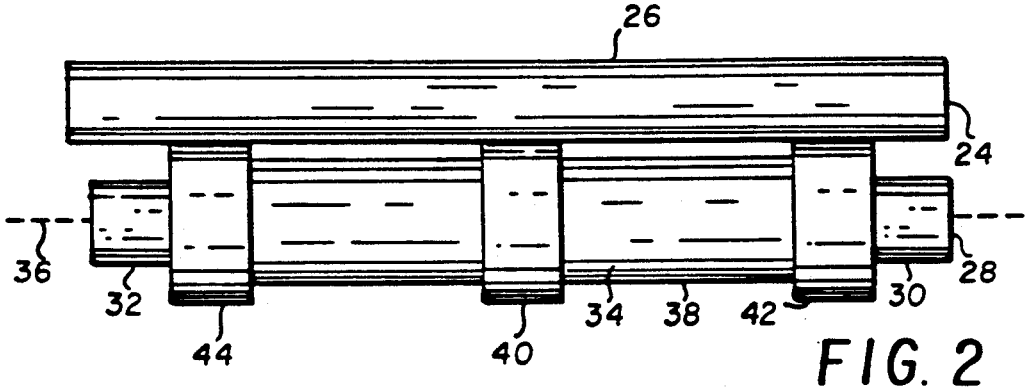
FIG. 2 is a somewhat enlarged front view of the rollers of FIG. 1 shown in an open position.
Figure 3:
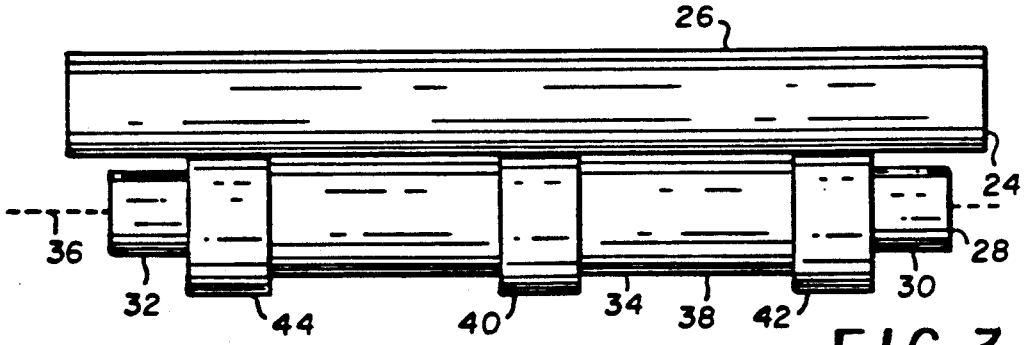
FIG. 3 is a front view similar to FIG. 2, but showing the rollers in a closed position
Figure 4:
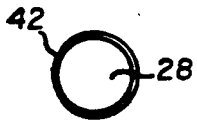
FIG. 4 is an end view of the roller of FIGS. 1–3 with the hub.

Referring to FIGS. 1–4, a thermal printer 10 has a dye donor web 12 traversing a path in the printer 10 between a donor supply spool 13 and a donor take-up spool 14. A printing platen 18 and a print head 20 are positioned along the donor web path to effect thermal transfer of dye from the dye donor web 12 onto a dye receiving medium 22. The dye receiver 22 traverses a path between a receiver supply spool 15 and a receiver take-up spool 16.

A nip-roller pair is provided for transporting the dye receiver 22. The nip-roller pair preferably includes a capstan roller. The pair includes a first roller 24 having a surface 26, and a second roller 28. The second roller 28 has first and second end portions 30, 32, a middle portion 24 intermediate the end portions 30, 32, a longitudinal axis 36, and a cylindrical surface 28 concentric with the longitudinal axis 36. The rollers 24, 28 are movable, one relative to the other, between an open position at which the rollers are spaced apart, and a closed position at which the rollers abut one another.

The cylindrical surface 38 is radially spaced a first preselected distance from the axis 36. The second roller 28 has a hub 40 with an outer surface concentric with the axis 36 and radially spaced from the axis 36. The surface of the hub 40 is spaced a greater distance from the axis 36 than the surface 38 of the second roller 28. The outer surface of the hub 40 extends radially outward from the axis 36 beyond the cylindrical surface 38 a distance sufficient to engage the dye receiver 22 without the receiver coming into contact with the cylindrical surface 38. By this construction, the dye receiver 22 can be transported by the hub 40.

The hub 40 is preferably formed of an elastomeric material. The hub 40 is compressible in response to transporting contact with the first roller 24 so that the surface of the hub 40 is flush with the cylindrical surface 38.

A single hub 40 is positioned on the middle portion 34 of the second roller 28. It is preferable to have two hubs with one hub 42 positioned on the first end portion 30 of the second roller 28 and the other hub 44 positioned on the second end portion 32 of the second roller 28. If desired, all three hubs 40, 42, 44 may be used.

Operation of the present invention is believed to be apparent from the foregoing description, but a few words will be added for emphasis. The hub is compressible in response to transporting contact with the first roller at the the closed position so that the hub surface is flush with the cylindrical surface for accurate registration during printing. The hub returns to its normal size when the compressive force is removed and thereby prevents the receiver media from adhering to the surface of the roller. The media is supported and transported by the hubs when printing is not occurring.

It can now be appreciated that there has been described a material transport roller that can transport material without scratching. The rollers have rough surfaces for good registration and compressible hubs to preventing sticking of the material to the rollers. The hubs hold the material away from the rough surface during transport when printing is not occurring. During printing, the rollers use the rough surfaces to accurately transport the material.

While the invention has been described with particular reference to the preferred embodiments, it will be understood by those skilled in the art that various changes may be made and equivalents may be substituted for elements of the preferred embodiment without departing from invention. For example, the number of hubs can be more than the three mentioned, and the size of the protruding surface of the hubs can be adjusted for various thicknesses of receiver media to prevent contact with the rough surface In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. For example, while the invention has been described with reference to thermal printing, it is equally applicable to other forms of printing and reproduction as well as other systems wherein sensitive material is transported. It is accordingly intended that the claims shall cover all such modifications and applications as do not depart from the true spirit and scope of the invention.

What is claimed is:

1. A nip-roller pair for transporting material, comprising:

a first roller having a surface; and a second roller having first and second end portions, a middle portion intermediate said end portions, a longitudinal axis, said rollers being moveable between an open position at which said rollers are spaced apart and a closed position at which said rollers abut one another, and a cylindrical surface concentric with said long axis and radially spaced a first preselected distance from said axis, said second roller having a hub with an outer surface concentric with said axis and radially spaced from said axis a distance greater than said first preselected distance, said hub outer surface extending radially outward beyond said cylindrical surface a distance sufficient to engage a sheet of material of material to be transported without said sheet of material coming into contact with said cylindrical surface so that said sheet can be transported by said hub with said rollers in the open position, said hub being compressible in response to transporting contact with said first roller so that said hub surface is flush with said cylindrical surface.

2. A nip-roller pair, as set forth in claim 1, wherein said hub is formed of an elastomeric material.

3. A nip-roller pair, as set forth in claim 1, wherein said hub is positioned on said middle portion of said second roller.

4. A nip-roller pair, as set forth in claim 1, wherein said hub is positioned on said first end portion of said second roller, and including a second hub positioned on said second end portion of said second roller.

5. A nip roller pair, as set forth in claim 4, further comprising a third hub positioned on said middle portion of said second roller.

6. In a thermal printer having a dye donor web traversing a path in the printer between a donor supply spool and a donor take-up spool and having a platen and a print head along said donor web path to effect thermal transfer of dye from said dye donor web onto a dye receiving web traversing a path in the printer between said print head and a dye receiving web take-up spool, the improvement comprising:

a nip-roller pair for transporting said dye receiving web, said nip-roller pair including:

a first roller having a surface; and a second roller having first and second end portions, a middle portion intermediate said end portions, a longitudinal axis, and a cylindrical surface concentric with said longitudinal axis and radially spaced a first preselected distance from said axis, said rollers being moveable between an open position at which said rollers are spaced apart and a closed position at which said rollers abut one another, said second roller having a hub with an outer surface concentric with said axis and radially spaced from said axis a distance greater than said first preselected distance, said hub outer surface extending radially outward beyond said cylindrical surface a distance sufficient to engage said dye receiving web without said web coming into contact with said cylindrical surface so that said web can be transported by said hub with said rollers in the open position, said hub being compressible in response to transporting contact with said first roller at the closed position so that said hub outer surface is flush with said cylindrical surface.

7. A nip-roller pair, as set forth in claim 6, wherein said hub is formed of an elastomeric material.

8. A nip-roller pair, as set forth in claim 6, wherein said hub is positioned on said middle portion of said second roller.

9. A nip-roller pair, as set forth in claim 6, wherein said hub is positioned on said first end portion of said second roller, and including a second hub positioned on said second end portion of said second roller.

10. A nip-roller pair, as set forth in claim 9, further comprising a third hub positioned on said middle portion of said second roller.

11. In a thermal printer having a platen and a print head to effect thermal transfer of dye from a dye donor onto receiving medium traversing a path between said print head and a take-up spool, the improvement comprising:

a first roller having a surface and being positioned along said path; and a second roller having first and second end portions, a middle portion intermediate said end portions, a longitudinal axis, and a cylindrical surface concentric with said longitudinal axis and radially spaced a first preselected distance from said axis, said rollers being moveable between an open position at which said rollers are spaced apart and a closed position at which said rollers abut one another, said second roller having a hub with an outer surface concentric with said axis and radially spaced from said axis a distance greater than said first preselected distance, said hub outer surface extending radially outward beyond said cylindrical surface a distance sufficient to engage said receiving medium without said receiving medium coming into contact with said cylindrical surface so that said receiver can be transported by said hub with said rollers in the open position, said hub being compressible in response to transporting contact with said first roller at the closed position so that said hub outer surface is flush with said cylindrical surface.

12. The improvement, as set forth in claim 11, wherein said hub is formed of an elastomeric material.

13. The improvement, as set forth in claim 11, wherein said hub is positioned on said middle portion of said second roller.

14. The improvement, as set forth in claim 11, wherein said hub is positioned on said first end portion of said second roller and including a second hub positioned on said second end portion of said second roller.

15. The improvement, as set forth in claim 14, including a third hub positioned on said middle portion of said second roller.

* * * * *

UNITED STATES PATENT AND TRADEMARK OFFICE

CERTIFICATE OF CORRECTION

PATENT NO. : 5,302,975

DATED : April 12, 1994

INVENTOR(S) : James A. Whritenor

It is certified that error appears in the above-indentified patent and that said Letters Patent is hereby corrected as shown below:

Col. 3, claim 1, line 59, delete "long" and isnert --longitudinal--.

Col. 4, claim 1, line 5, after "hub" insert --outer--.

Signed and Sealed this

First Day of November, 1994

*Attest:*

*Attesting Officer*

BRUCE LEHMAN

*Commissioner of Patents and Trademarks*